US007857243B2

(12) United States Patent
Li

(10) Patent No.: US 7,857,243 B2
(45) Date of Patent: Dec. 28, 2010

(54) HIGH FREQUENCY DISINTEGRATOR

(75) Inventor: Wen-Chi Li, Taipei (TW)

(73) Assignee: Exland Biotech Inc., Taipei (TW)

( * ) Notice: Subject to any disclaimer, the term of this patent is extended or adjusted under 35 U.S.C. 154(b) by 204 days.

(21) Appl. No.: 12/231,626

(22) Filed: Sep. 3, 2008

(65) Prior Publication Data

US 2010/0051730 A1 Mar. 4, 2010

(51) Int. Cl.
*B02C 19/00* (2006.01)

(52) U.S. Cl. ..... 241/1; 241/65

(58) Field of Classification Search ..... 241/1, 241/65, 301

See application file for complete search history.

(56) References Cited

U.S. PATENT DOCUMENTS 4,697,751 A * 10/1987 Chiba ..... 241/301
4,874,137 A * 10/1989 Chiba ..... 241/301

* cited by examiner

*Primary Examiner*—Faye Francis
(74) *Attorney, Agent, or Firm*—Peter F. Corless; Steven M. Jensen; Edwards Angell Palmer & Dodge LLP

(57) ABSTRACT

A high frequency disintegrator includes a plurality of high frequency vibration generators, a plurality of connectors, and at least a heat exchanger. The high frequency vibration generators each have an operational portion that axially outputs high frequency vibration energy. The connectors are respectively connected to the high frequency vibration generators, and each include an action portion for allowing the operational portion to axially output the high frequency vibration energy, an inlet, and an outlet, wherein the inlet and the outlet are connected to the action portion. The connectors are connected in series. The heat exchanging device dissipates heat from the connectors. The high frequency disintegrator eliminates the drawbacks of the conventional techniques.

20 Claims, 5 Drawing Sheets

HIGH FREQUENCY DISINTEGRATOR

BACKGROUND OF THE INVENTION

1. Field of the Invention

The present invention relates to material disintegration techniques, and more particularly, to a high frequency disintegrator for extracting materials.

2. Description of Related Art

Ultrasonic technology is well known in the art for the following applications: medical ultrasonography, ultrasonic motion drive, ultrasonic probing, ultrasonic signal detection, and ultrasound for industrial processing. Technically, ultrasounds are sounds that cannot be heard by the human ear, and they generate a physical vibration that is transmitted through a medium. For ultrasound in a fluid, cavitation is created in the fluid by highly intensive ultrasonic waves. Such cavitation generates small vacuum bubbles having a diameter of approximately one-ten-thousandth centimeter, and these small vacuum bubbles, when being broken, are able to locally generate a pressure of 1,000 atm, which in turn creates a strong impact to wash away dirt or hit cell walls of cells in materials, thereby releasing contents (or lysate) of cells when the cell walls are broken.

Referring to FIG. 1, a conventional ultrasonic disintegrator 1 is illustrated. The ultrasonic disintegrator 1 includes an ultrasonic device 11, a vibration head 12 connected to the ultrasonic device 11, a containing device 13, and a stirring device 14. The ultrasonic device 11 is installed at the center of the containing device 13. The vibration head 12 has a piezoelectric material (e.g. piezoelectric blade) therein through which a piezoelectric effect is generated, thereby creating high frequency vibration. Besides, the containing device 13 contains a medium and a material (such as a solid) therein. The medium can be a fluid medium for transferring high frequency vibration energy, for example, a fluid based on a liquid (such as water). The stirring device 14 is installed inside the containing device 13, for continuously stirring the medium and the material.

Through the use of the ultrasonic disintegrator 1, during material disintegration in practice, vibration of the vibration head 12 transfers the high frequency vibration energy to the containing device 13, allowing a plurality of small vacuum bubbles to be generated by cavitation in the medium surrounding the vibration head 12. And, an impact created when the small vacuum bubbles are broken is used to disintegrate the material, thereby accomplishing the result of material disintegration.

However, by the aforementioned conventional technique, as the ultrasonic device 11 and the vibration head 12 are located at the center of the containing device 13, the vibration head 22 transfers the high frequency vibration energy downward, and thus the generated high frequency vibration energy tends to be easily concentrated at the center and gradually decreased toward the periphery of the containing device 13. As such, the material situated at the periphery of the containing device 13 cannot be effectively disintegrated as expected due to insufficient vibration energy, thereby leading to uneven disintegration. Moreover, due to such unevenness, the medium and the material must be repeatedly stirred. Even so, it is difficult to confirm whether the desired evenness is reached or not, while the amount of disintegrated material obtained is limited even after a long period of time of operation. Hence, the above conventional technique is only applicable for laboratory-scale use but not for large-scale use.

Moreover, the containing device 13 of the conventional ultrasonic disintegrator 1 is nearly sealed. When the high frequency vibration energy continues to disintegrate material in the containing device 13, a large amount of heat is generated, thereby increasing the temperature of the medium. When this happens, the disintegration process must be terminated and an additional temperature-cooling step should be performed to prevent the medium from being overheated, so as not to affect stability and integrity of the properties of the disintegrated material. In particular, when disintegrating a material such as Chinese herbal medicine, natural organic product, etc, a high temperature usually destroys the structure of the cell contents or lysate of the material to be extracted.

In other words, even if the aforementioned conventional technique may disintegrate the material into powder particles, it is not able to carry out an extraction process. And, the amount of material that can be disintegrated one time is limited, such that the conventional technique is not suitable for large-scale use.

As shown in FIG. 2, the Taiwanese Patent Application No. 093119250 discloses another conventional ultrasonic disintegrator 2. The ultrasonic disintegrator 2 includes an ultrasonic device 21, a vibration head 22 connected to the ultrasonic device 21, and a suspension carrier device 23 connected to the vibration head 22. The vibration head 22 has a piezoelectric material. The suspension carrier device 23 includes a transmission tube 231 connected to the vibration head 22, a transmission pump 232 connected to the transmission tube 231, and a cooler 233 connected to the transmission tube 231, thereby using the transmission pump 232 to control the flow speed, and allowing the material and the medium to flow in the transmission tube 231, for disintegration.

However, the suspension carrier device 23 of the conventional ultrasonic disintegrator 2 is nearly sealed. Even if the cooler 233 is installed in the suspension carrier device 23, because the cooler 233 is inside the suspension carrier device 23, when the ultrasonic device 21 continues to operate and the internal temperature of the suspension carrier device 23 keeps rising, the temperature-cooling effect of the cooler 233 cannot compensate for the temperature rise of the medium in the suspension carrier device 23, that is, the cooler 233 is unable to prevent the medium temperature from rising, thereby causing the material to block the transmission tube 231. Hence, just like the above conventional technique using the ultrasonic disintegrator 1, the medium temperature is increased during the operation of the ultrasonic disintegrator 2 and the disintegration process must then be terminated so as to allow an additional temperature-cooling step to be performed to prevent the medium from being overheated and avoid affecting the material and the disintegrated powder particles. This however undesirably elongates the processing time.

Furthermore, in order to be connected to the vibration head, the transmission tube 231 of this ultrasonic disintegrator 2 must have a size greater than that of the vibration head 22, and accordingly, the vibration head 22 has relatively less functional unit area and shorter functional time. In order to achieve evenness, the material must be continuously circulated. However, as the vibration head 22 transfers the high frequency vibration energy downward, if the material circulated by such an ultrasonic disintegrator 2 is located on the sidewall of the transmission tube 231, it may not receive sufficient vibration energy and then the expected disintegrating effect cannot be achieved. Even if the material is located right at the center of the transmission tube 231, effective disintegration cannot be achieved as well due to short-time operation applied to the material being continuously circulated. As a result, even if the material is continuously circulated, it cannot ensure that effective disintegration of all the material is accomplished.

Although the above ultrasonic disintegrator may disintegrate the material into nano-scale powder particles, it fails to effectively control the temperature therein and has limited operational/functional location and time, and it may destroy the structure of contents (or lysate) of the material and is not applicable for effective disintegration and extraction. Thereby, the above ultrasonic disintegrator is not suitable for large-scale use.

In addition, the aforementioned two conventional ultrasonic disintegrators are each a single and independent apparatus. When massive amount of material disintegration is required, a considerable number of associated devices/equipment must be simultaneously utilized. Hence, if the conventional techniques are applied in large-scale use, the manufacturing cost is certainly increased.

Therefore, the problem to be solved here is to develop a material disintegration technique, which provides even disintegration and constant temperature control and is applicable for large-scale use, so as to overcome the drawbacks of the above conventional techniques.

SUMMARY OF THE INVENTION

In view of the above drawbacks of the conventional techniques, an objective of the present invention is to provide a high frequency disintegrator to achieve even material disintegration.

Another objective of the present invention is to provide a high frequency disintegrator to effectively control the temperature therein.

A further objective of the present invention is to provide a high frequency disintegrator applicable for large-scale use.

To achieve the aforementioned and other objectives, the present invention provides a high frequency disintegrator comprising: a plurality of high frequency vibration generators each having an axially installed operational portion for outputting high frequency vibration energy; a plurality of connectors respectively connected to the plurality of high frequency vibration generators, each of the connectors comprising an action portion for allowing the operational portion to output the high frequency vibration energy axially, an inlet, and an outlet, wherein the inlet and outlet communicate with the action portion and are located on different axial planes from each other, and the connectors are connected in series; and at least a heat exchanging device connected to the connectors, for dissipating heat from the connectors.

In the high frequency disintegrator, the action portion is an axially extended action channel. In an embodiment, there is an extension portion extended from an end of the action portion opposite to the operational portion, so as to increase the length of the action channel and further to increase the time in which the high frequency vibration energy acts on a material introduced into the high frequency disintegrator, such that the material can be more evenly disintegrated. In other embodiments, the axial length of the action portion can be directly increased so as to increase the path length and time in which the high frequency vibration energy acts on the material.

In comparison with the conventional techniques, the high frequency disintegrator according to the present invention includes the plurality of connectors mutually connected in series, each connector having a relatively longer action portion, and the heat exchanging device that may control the temperature in the high frequency disintegrator. Thus, the high frequency disintegrator can disintegrate the material to a desirable degree of disintegration, and eliminates the drawbacks of the conventional techniques such as inapplicable for large-scale use, uneven disintegration and ineffective temperature control.

DETAILED DESCRIPTION OF PREFERRED EMBODIMENTS

Preferred embodiments of a high frequency disintegrator proposed by the present invention are described in detail as follows with reference to FIGS. 3 to 6. It should be understood that the drawings are simplified schematic diagrams only showing the components relevant to the present invention, and the layout of components could be more complicated in practical implementation.

Figure 2:
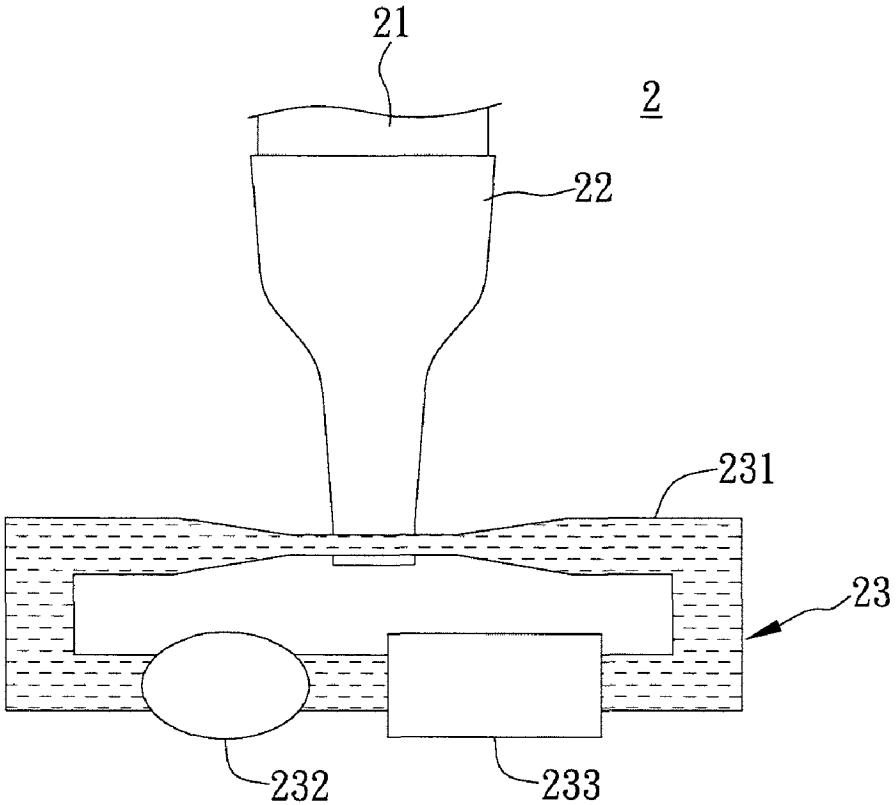
FIG. 2 (PRIOR ART)
FIG. 2 is a structural schematic diagram of an ultrasonic disintegrator disclosed by Taiwanese Patent Application No. 093119250.
Figure 1:
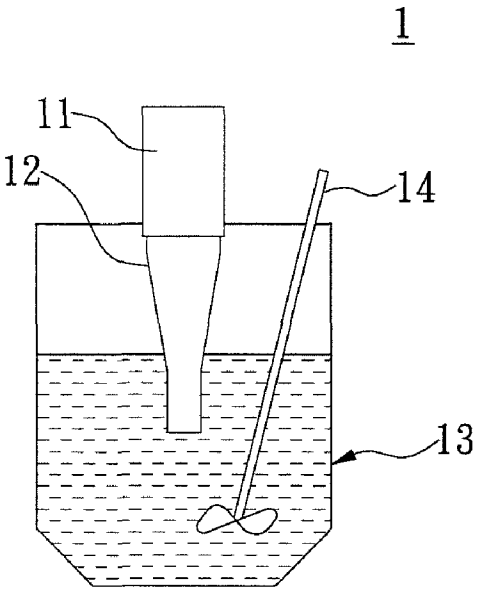
FIG. 1 (PRIOR ART)
FIG. 1 is a structural schematic diagram of a conventional ultrasonic disintegrator.
Figure 3:
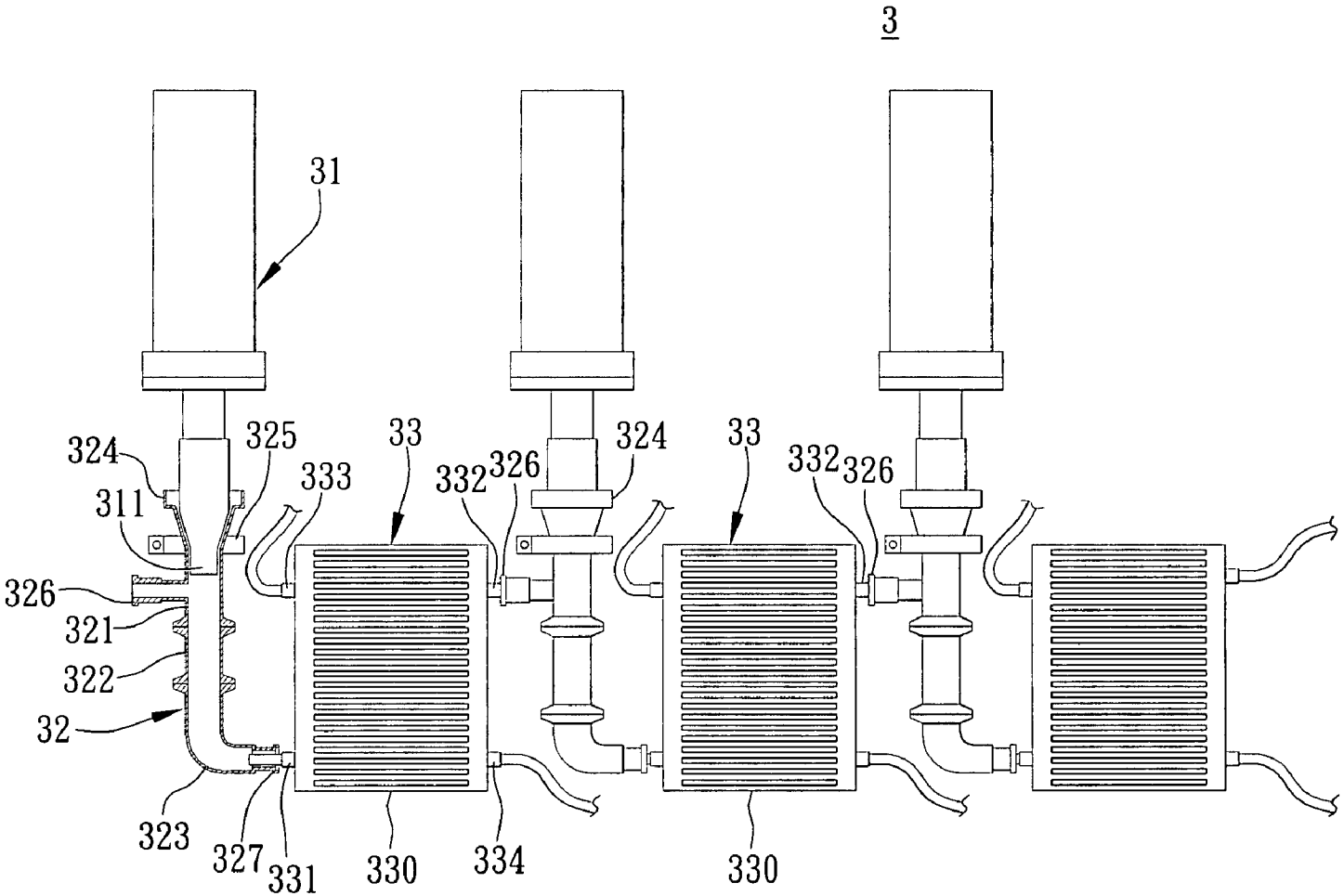
FIG. 3 is a structural schematic diagram of a high frequency disintegrator according to an embodiment of the present invention.
Figure 4:
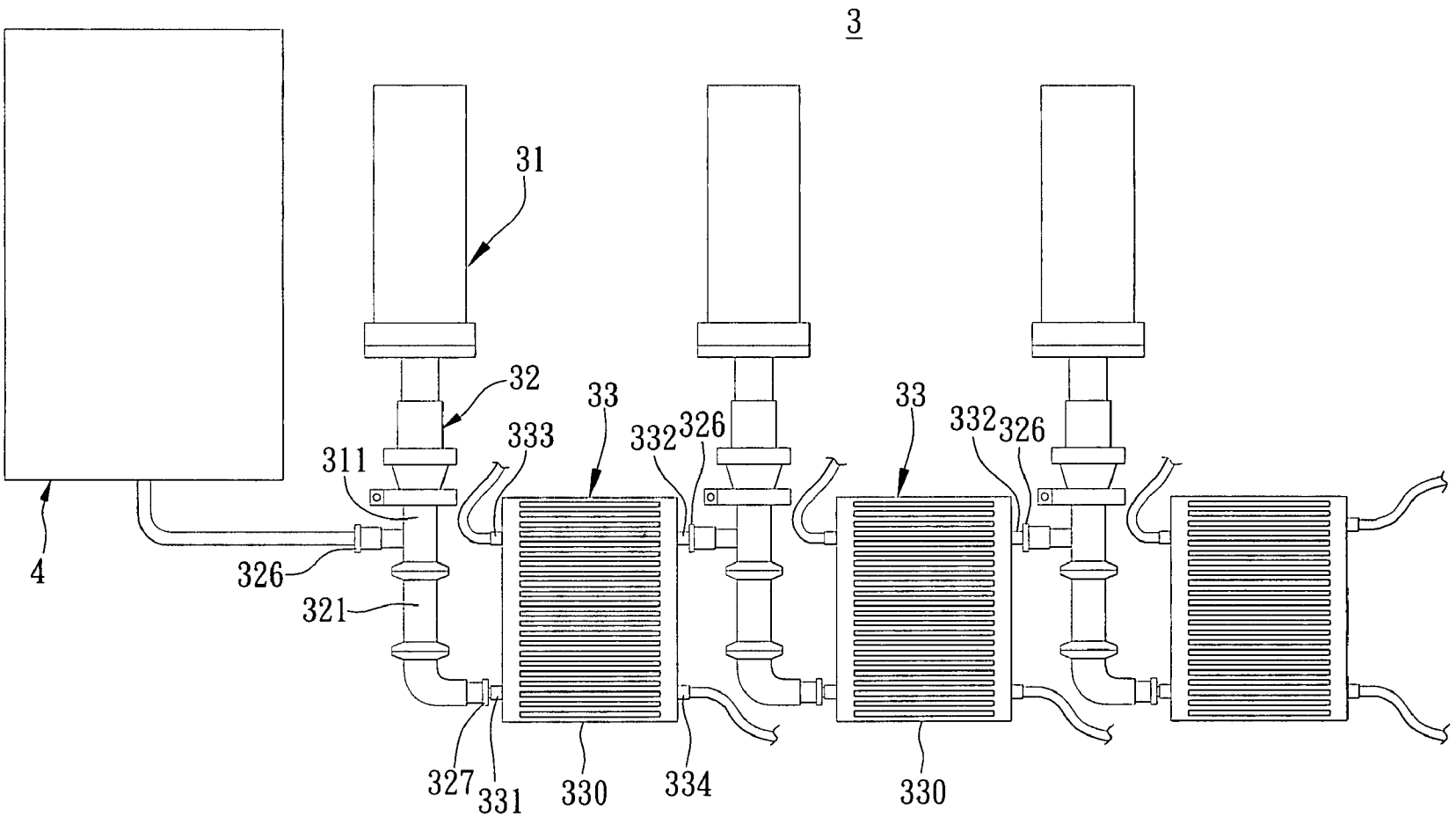
FIG. 4 is a schematic diagram showing an operation state of the high frequency disintegrator depicted in FIG. 3.

FIGS. 3 and 4 illustrate a high frequency disintegrator according to an embodiment of the present invention. Referring to FIG. 3, a high frequency disintegrator 3 according to an embodiment of the present invention includes: a plurality of high frequency vibration generators 31, a plurality of connectors 32 respectively connected to the high frequency vibration generators 31, and at least a heat exchanging device 33 for dissipating heat from the plurality of the connectors 32.

In this embodiment, the high frequency vibration generator 31 can be an ultrasonic vibration generator or any other equivalent component that may generate high frequency vibrations. The high frequency vibration generator 31 has an axially installed operational portion 311, and the operational portion 311 axially outputs high frequency vibration energy (such as focused ultrasound). The operational portion 311 may comprise a piezoelectric material or any other equivalent material.

The connectors 32 each can be a long tube member made of a high-strength material such as stainless steel, titanium alloy, high nickel alloy, etc. The connectors 32 are mutually connected in series and are sequentially coupled to the corresponding high frequency vibration generators 31. In this embodiment, the connectors 32 each includes an axially installed action portion 321, an extension portion 322 connected to the action portion 321, a bending portion 323 connected to the extension portion 322, a connecting portion 324 connected to the action portion 321, a clamping portion 325 connecting the connecting portion 324 to the high frequency vibration generator 31, an inlet 326, and an outlet 327, wherein the inlet 326 and the outlet 327 are located at different axial planes and are connected to the action portion 321.

The action portion 321 can be an axially extended action channel so as to increase the path and the time through which a material introduced into the high frequency disintegrator 3 passes. The extension portion 322 is axially extended from the action portion 321 in a direction opposite to the operational portion 311, so as to further increase the path and the time through which the material passes. The extension portion 322 communicates with the bending portion 323. The connecting portion 324 is coupled to an end of the action portion 321 corresponding to the operational portion 311. In this embodiment, the connecting portion 324 can be a metallic pipe provided around and attached to the operational portion 311, allowing a front part of the operational portion 311 to enter the action portion 321. The clamping portion 325 can be a C-shaped ring, which may be fixed to the operational portion 311 peripherally by fasteners such as screws (not shown). The inlet 326 is formed on one side of the action portion 321 and communicates with the action portion 321 so as to introduce the material and a medium into the action portion 321 via the inlet 326 (to be described later). The outlet 327 is located at an end of the bending portion 323 opposite to the extension portion 322. The inlet 326 and the outlet 327 are located on different axial planes.

It should be noted that, for the sake of easy fabrication, the connector 32 may be assembled and fabricated in several stages in this embodiment. For example, the action portion 321, the connecting portion 324 and the inlet 326 are integrally formed, and the bending portion 323 and the outlet 327 are integrally formed. Alternatively, components of the connector 32 can be fabricated separately in the following three groups: the action portion 321, the connecting portion 324 and the inlet 326; the extension portion 322; and the bending portion 323 and the outlet 327. It is also understood that, all or some of the aforementioned components of the connector 32 can be integrally formed. The extension portion 322 can be omitted and the action portion 321 is directly extended. The extension portion 322 and the bending portion 323 can be omitted and the action portion 321 is directly extended and partially bent.

In other words, the present invention may also adopt any equivalent structure in which the connector 32 is connected to the high frequency vibration generator 31, the operational portion 311 can axially output the high frequency vibration energy, the action portion 321 has an axially extended action channel, and the inlet 326 and the outlet 327 communicating with the action portion 321 are respectively located on different axial planes. Moreover, the connecting portion 324 is installed around the operational portion 311 and is fixed to the operational portion 311 by the clamping portion 325 in this embodiment, while in other embodiments, if the connecting portion 324 has been tightly fixed to or engaged with the operational portion 311, the clamping portion 325 and the corresponding fasteners may be omitted.

The heat exchanging device 33 in this embodiment may include a heat exchanger 330, wherein the heat exchanger 330 can be a plate heat exchanger and comprises a material inlet 331, a material outlet 332, a fluid inlet 333 and a fluid outlet 334. The material inlet 331, the material outlet 332, the fluid inlet 333 and the fluid outlet 334 are provided on sides of the heat exchanger 330. The material inlet 331 communicates with the material outlet 332, and the fluid inlet 333 communicates with the fluid outlet 334. The outlet 327 of one of the connectors 32 is connected to the material inlet 331 of this heat exchanging device 33, and the material outlet 332 of the heat exchanging device 33 is connected to the inlet 326 of a next one of the connectors 32 connected in series. The at least a heat exchanging device 33 may include a plurality of heat exchanging devices 33 connected in series. The material outlet 332 of a next one of the heat exchanging devices 33 connected in series can be connected to the inlet 326 of a further next one of the connectors 32 connected in series. This thus forms a series-connection configuration. The fluid inlet 333 of each of the heat exchanging devices 33 may be externally connected to a cooling device (not shown), and the fluid outlet 334 of each of the heat exchanging devices 33 can be connected to a containing component (not shown). The containing component is, for example, a water tank.

Hence, a fluid (such as cold water) can be introduced into the heat exchanging device 33 via the cooling device, and after performing heat exchange in the heat exchanging device 33, a fluid (such as hot water) generated after the heat exchange is then drained out via the fluid outlet 334 into, for example, the containing component, so as to control the temperature. Alternatively, in other embodiments, the fluid outlet 334 can be connected to the aforementioned cooling device, thereby omitting the containing component. This allows the cold and hot fluid inside the heat exchanging device 33 to circulate, and thereby achieves a good temperature control effect.

FIG. 4 shows an operation state of the high frequency disintegrator of this embodiment. As shown in FIG. 4, when in operation, the high frequency disintegrator 3 of the present invention is externally connected to a machine 4, allowing the machine 4 to be connected to the inlet 326. The machine 4 contains a medium and a material to be disintegrated (both not shown) therein. In this embodiment, the medium is, but not limited to, a liquid such as pure water. In other embodiments, the medium can be a gas or any other fluid. The material can be any material to be disintegrated, such as tea, ganoderma, mushroom, fruit, pearl or any material that requires disintegration, in order to extract the contents (or lysate) of the material. The medium is used to transmit or deliver the material and allow the material to enter the action portion 321 via the inlet 326. The operational portion 311 axially outputs high frequency vibration energy to generate a strong impact for disintegrating the material. As the action portion 321 provides a relatively longer path for the high frequency vibration energy to disintegrate the material, and the action portion 321 in this embodiment is further axially connected to the extension portion 322, the material can then be continuously subjected to the high frequency vibration energy in the single connector 32. Thus, the path and the time that the operational portion 311 impacts on the material are increased to sufficiently disintegrate the material, thereby enhancing the evenness of powder particles after disintegration of the material, and allowing the contents (or lysate) of the material to be completely released.

After the longer path and time for impacting on the material, the disintegrated material is transmitted by the medium and goes through the bending portion 323 and is then drained out from the first connector 32 (the leftmost one shown in FIG. 4) via the outlet 327, and subsequently, the material enters the heat exchanging device 33. The heat exchanger 330 has a heat dissipating portion (not shown) therein for the medium and the material to pass therethrough. The fluid passing through the fluid inlet 333 flows around the heat dissipating portion to greatly lower the temperature of the disintegrated material in the medium, thereby maintaining the material at a constant temperature. It is understood that, the heat exchanging device 33 of this embodiment may include any existing heat exchanger, and the specific structure thereof is not further detailed here.

After being subjected to the temperature control, the material exits via the material outlet 332 and enters the action portion 321 of the next connector 32 (the middle one shown in FIG. 4). The aforementioned disintegration process is then repeated. As such, multiple disintegrations of the material are performed to desirably achieve even material disintegration. In comparison to the conventional technique, the high frequency disintegrator of this embodiment can disintegrate more material and maintain the material at a constant temperature for successful disintegration, thereby suitable for large-scale use.

In this embodiment, the high frequency disintegrator 3 comprises three high frequency vibration generators 31, three connectors 32 and three heat exchanging devices 33, which are connected in series. This allows more material to be disintegrated simultaneously and also facilitates a later extraction process. Alternatively, in other embodiments, more high frequency vibration generators 31, connectors 32 and heat exchanging device 33 may be connected in series in response to different operation situations. Even if only one high frequency vibration generator 31, one connector 32, and one heat exchanging device 33 are used, the high frequency disintegrator of the present invention still provides the increased action time and path and may effectively control the temperature, as compared to the conventional technique. Hence, the series-connection design allows a more effective and even disintegration of all the material and ensures the integrity of the material contents (or lysate) by controlling the temperature.

It is to be noted that, in this embodiment, the material is transmitted via the medium (such as water), and therefore, the material after being disintegrated is mixed with water. Hence, before extraction, a separation technique is adopted to separate the disintegrated material from water, and then the contents (or lysate) of the material can be extracted. For example, a branching system (not shown) is provided to allow the disintegrated material and the medium to pass through a filtering portion (such as a separation membrane or a centrifuge) of the branching system and to be separated into powder particles and fluid (such as water). As the aforementioned separation technique is a general conventional separation technique, its theory and action are known in the art and are not further described here.

Also, during the disintegration process performed by the high frequency disintegrator of this embodiment, the power of the high frequency vibration generator 31 can be adjusted in response to different operation situations. For example, in order to obtain nano-scale powder particles, the power of the high frequency vibration generator 31 can be increased to allow the material to be disintegrated into nano-scale powders in a shorter period of time, thereby obtaining the nano-scale powder particles at a faster rate. In order to extract a liquid extract of the material, the power of the high frequency vibration generator 31 can be reduced so as to disintegrate the material until the desired material contents are released; then, the aforementioned separation technique is used to separate the disintegrated material powder particles from the liquid, thereby obtaining the liquid extract of the material.

When the high frequency vibration generator 31 operates, ultrasonic energy generated thereby allows the temperature of the medium and the material to be increase drastically. And, the longer the operational portion 311 operates, the faster the temperature would rise. It is thus desirable to use a heat exchanging device 33 having a good temperature control effect, such that the optimal temperature control effect can be achieved in a short period of time, thereby making the whole extraction process performed in a state of constant temperature and avoiding any change in the contents (or lysate) of the material. In this embodiment, the heat exchanging device 33 may be connected to an external cooling device and have a hot water drain design, thereby providing a good cooling and temperature control effect. Further in this embodiment, each connector 32 is connected to a heat exchanging device 33, thereby providing excellent temperature lowering and temperature control effects. Moreover, the heat exchanging device 33 of the present invention is not limited to the forms shown in FIGS. 3 and 4. Any configuration having the material inlet 331 for being connected to the outlet 327, the material outlet 332 for transmitting the material to the next connector 32, the fluid inlet 333 for being externally connected to the cooling device, and the fluid outlet 334 for draining hot water out, may serve as the heat exchanging device 33 of the present invention.

Figure 5:
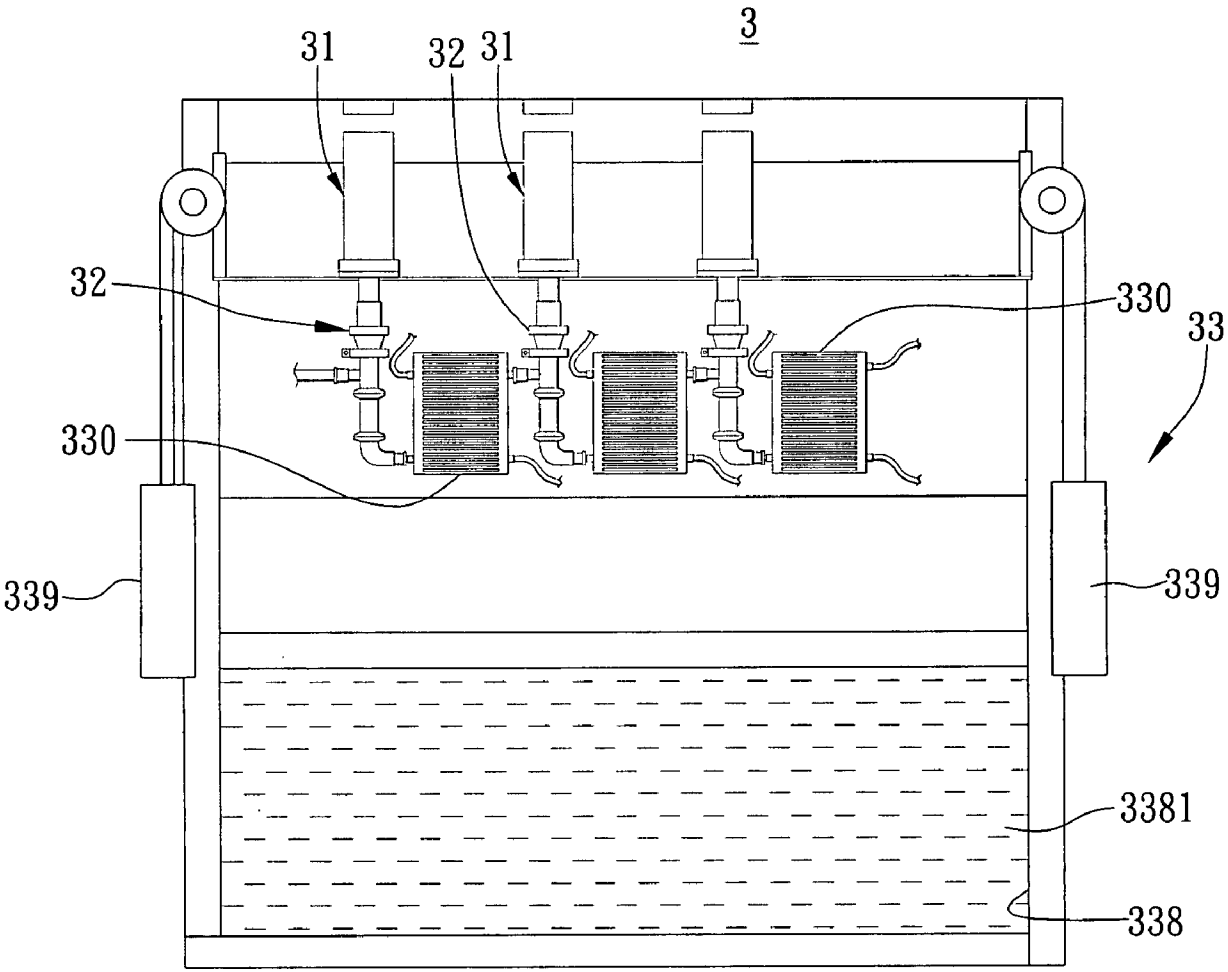
FIG. 5 is a schematic diagram showing an application of a high frequency disintegrator according to another embodiment of the present invention.

FIG. 5 shows an application of the high frequency disintegrator according to another embodiment of the present invention, wherein components same as or similar to those in the aforementioned embodiments are labeled with same or similar reference numerals and the detailed descriptions thereof are omitted.

As shown in FIG. 5, the heat exchanging device 33 of the high frequency disintegrator 3 in this embodiment differs from that in the aforementioned embodiment in that, the heat exchanging device 33 of this embodiment includes a plurality of heat exchangers 330, a containing component 338 for receiving the plurality of heat exchangers 330, and transmission components 339. In this embodiment, the containing component 338 is, for example, a big water tank disposed under the plurality of heat exchangers 330, and contains a cooling fluid 3381 such as water therein. The size of the containing component 338 is enough to accommodate all of the heat exchangers 330 that are connected in series. The transmission components 339 are provided on two sides of the high frequency disintegrator 3, and are movably connected to the high frequency vibration generators 31, so as to drive the heat exchangers 330 to be submerged in the cooling fluid 3381. During the disintegration process, the movement of the transmission components 339 can be controlled such that the transmission components 339 directly drive the heat exchangers 330 connected to the connectors 32 to move into the containing component 338, for performing cooling and temperature control.

Although the transmission components 339 in this embodiment are installed on two sides of the high frequency disintegrator 3 and are movably connected to the high frequency vibration generators 31, the position and structure of the transmission components 339 in other embodiments may be altered, for example, the transmission components 339 may be connected to the connectors 32 as long as they drive the heat exchangers 330 to be submerged into the cooling fluid 3381. The prevent invention is not limited to this embodiment. Alternatively, the connectors 32 may be submerged in the cooling fluid 3381 within the containing component 338. This is advantageous for a material that requires disintegration at a lower temperature because a constant low temperature control can be provided.

Figure 6:
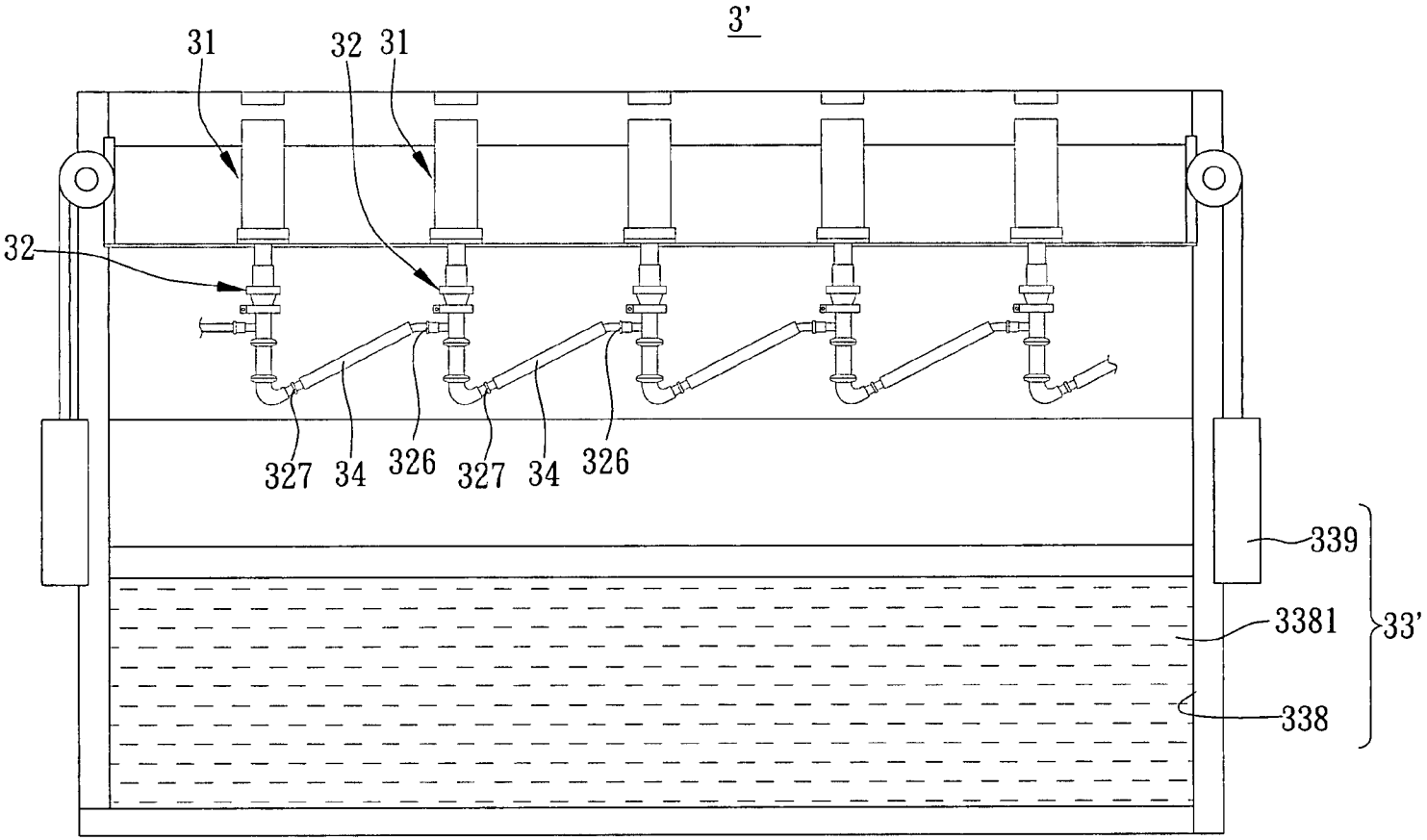
FIG. 6 is a schematic diagram showing an application of a high frequency disintegrator according to a further embodiment of the present invention.

FIG. 6 shows an application of a high frequency disintegrator according to a further embodiment of the present invention, wherein components same as or similar to those in the aforementioned embodiments are labeled with same or similar reference numerals and the detailed descriptions thereof are omitted.

As shown in FIG. 6, the high frequency disintegrator 3' of this embodiment differs from those of the aforementioned embodiments in not having the heat exchanger 330 mentioned above. The heat exchanging device 33' includes a containing component 338, a cooling fluid 3381 contained in the containing component 338, and transmission components 339, so as to directly perform heat dissipation on the plurality of connectors 32. For the plurality of connectors 32 respectively connected to the high frequency vibration generators 31, the outlet 327 of each of the connectors 32 is connected to the inlet 326 of another connector 32 via a transmission tube 34, and by this manner, the high frequency vibration generators 31 are connected to one another in series. The containing component 338 is a big water tank, and is installed under the plurality of connectors 32 and transmission tubes 34. The transmission components 339 are provided on two sides of the high frequency disintegrator 3, and are movably connected to the high frequency vibration generators 31. By driving the transmission components 339, the plurality of connectors 32 and transmission tubes 34 can be submerged into the cooling fluid 3381 such as cold water where temperature lowering is conducted, so as to allow the connectors 32 and the transmission tubes 34 to be maintained at an appropriate temperature and achieve the temperature control effect.

It is understood that, any configuration that may drive the connectors 32 to be submerged in the cooling fluid 3381 can serve as the transmission component of the present invention. A cooling device (not shown) may installed in or externally connected to the containing component 338 to circulate and cool the cooling fluid 3381 in the containing component 338, so as to maintain the cooling fluid 3381 at a specific temperature. As such, the temperature of the material in the connectors 32 and the transmission tubes 34 can be controlled, thereby relatively saving the equipment cost.

In comparison to the conventional technique, the high frequency disintegrator of the present invention is formed by a plurality of high frequency vibration generators, a plurality of connectors and a plurality of heat exchanging devices, which are connected in series, allowing the connectors to provide longer action time and path for simultaneously and evenly disintegrate more material, such that the high frequency disintegrator is ready for large-scale use. Moreover, temperatures during and after the material disintegration are effectively controlled to ensure the integrity of the material properties and the large-scale usage. Based on the above, the high frequency disintegrator of the present invention has solved the various drawbacks in the prior art and is highly industrially applicable.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A high frequency disintegrator comprising:

a plurality of high frequency vibration generators each having an axially installed operational portion for outputting high frequency vibration energy;

a plurality of connectors respectively connected to the plurality of high frequency vibration generators, each of the connectors comprising an action portion for allowing the operational portion to output the high frequency vibration energy axially, an inlet, and an outlet, wherein the inlet and the outlet communicate with the action portion and are located on different axial planes from each other, and the connectors are connected in series; and at least two heat exchanging devices connected to the connectors, for dissipating heat from the connectors.

2. The high frequency disintegrator of claim 1, wherein the high frequency vibration generators are ultrasonic vibration generators.

3. The high frequency disintegrator of claim 1, wherein the action portion comprises an action channel.

4. The high frequency disintegrator of claim 1, wherein each of the connectors further comprises an extension portion extended from an end of the action portion opposite to the operational portion.

5. The high frequency disintegrator of claim 4, wherein each of the connectors further comprises a bending portion connected to the extension portion and located between the extension portion and the outlet.

6. The high frequency disintegrator of claim 1, wherein each of the connectors further comprises a connecting portion connected to the action portion, and a clamping portion connecting the connecting portion to a corresponding one of the high frequency vibration generators.

7. The high frequency disintegrator of claim 1, wherein the inlet allows a material and a medium to be introduced into the action portion.

8. The high frequency disintegrator of claim 7, wherein the medium is a fluid.

9. The high frequency disintegrator of claim 1, wherein one of the heat exchanging devices comprises at least a heat exchanger.

10. The high frequency disintegrator of claim 9, wherein the heat exchanger comprises a material inlet, a material outlet, a fluid inlet and a fluid outlet, wherein the outlet of one of the connectors is connected to the material inlet, and the inlet of an adjacent one of the connectors connected in series is connected to the material outlet.

11. The high frequency disintegrator of claim 10, wherein the fluid inlet is externally connected to a cooling device, and the fluid outlet is connected to a containing component.

12. The high frequency disintegrator of claim 10, wherein the fluid inlet and the fluid outlet are connected to a cooling device.

13. The high frequency disintegrator of claim 1, wherein one of the heat exchanging devices comprises a containing component and a cooling fluid contained in the containing component.

14. The high frequency disintegrator of claim 13, wherein the containing component is a water tank, and the cooling fluid is water.

15. The high frequency disintegrator of claim 13, wherein the heat exchanging device further comprises at least a transmission component for driving the connectors to be submerged in the cooling fluid.

16. The high frequency disintegrator of claim 1, wherein one of the heat exchanging devices comprises at least a heat exchanger connected to the connectors, a containing component, and a cooling fluid contained in the containing component.

17. The high frequency disintegrator of claim 16, wherein the heat exchanger comprises a material inlet, a material outlet, a fluid inlet and a fluid outlet, wherein the outlet of one of the connectors is connected to the material inlet, and the inlet of an adjacent one of the connectors connected in series is connected to the material outlet.

18. The high frequency disintegrator of claim 17, wherein the fluid inlet is externally connected to a cooling device, and the fluid outlet is connected to the containing component.

19. The high frequency disintegrator of claim 17, wherein the fluid inlet and the fluid outlet are connected to the containing component.

20. The high frequency disintegrator of claim 17, wherein the heat exchanging device further comprises at least a transmission component for driving the heat exchanger to be submerged in the cooling fluid.

* * * * *